United States Patent [19]

Benelli

[11] Patent Number: 4,538,502

[45] Date of Patent: Sep. 3, 1985

[54] RECONVERSION DEVICE FOR A GUN FROM SEMI-AUTOMATIC TO PUMP OPERATION

[75] Inventor: Paolo Benelli, Pesaro, Italy

[73] Assignee: Benelli Armi S.p.A., Italy

[21] Appl. No.: 483,218

[22] Filed: Apr. 8, 1983

[30] Foreign Application Priority Data

Apr. 28, 1982 [IT] Italy ..... 44010 A/82

[51] Int. Cl.[3] ..... F41C 7/06

[52] U.S. Cl. ..... 89/128

[58] Field of Search ..... 42/17; 89/128, 182, 89/183, 185

[56] References Cited

U.S. PATENT DOCUMENTS

| | | | |
|---|---|---|---|
| 987,350 | 3/1911 | Febiger | 89/128 |
| 988,996 | 4/1911 | Frommer | 89/128 |
| 2,341,260 | 2/1944 | Barnes | 89/128 |
| 4,395,937 | 8/1983 | Ottolini | 89/128 |

*Primary Examiner*—Stephen C. Bentley

[57] ABSTRACT

A reconversion device permits a rapid conversion from a semi-automatic operation system to a pump system and vice versa for fixed barrel sporting and defense guns without disassembling the gun.

3 Claims, 5 Drawing Figures

FIG. 1
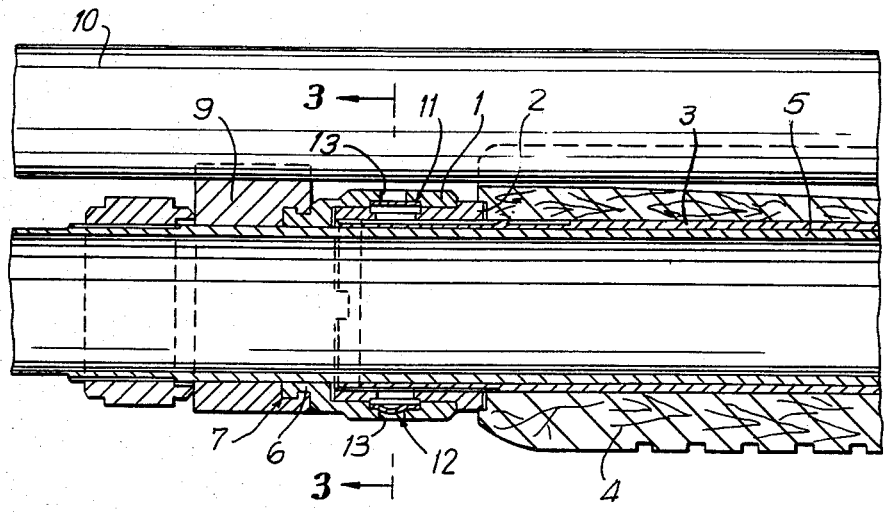
FIG. 2
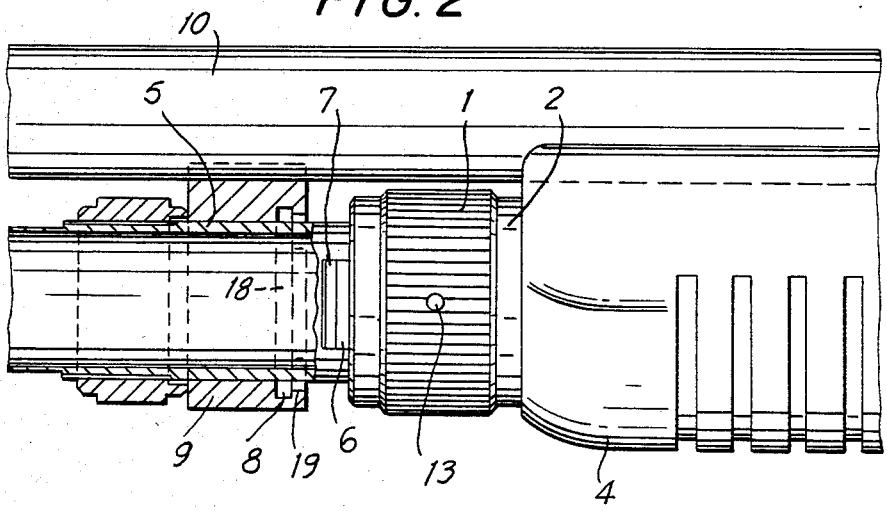
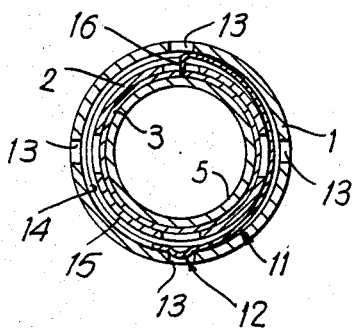
FIG. 3

RECONVERSION DEVICE FOR A GUN FROM SEMI-AUTOMATIC TO PUMP OPERATION

The present invention relates to a reconversion device from a semi-automatic operation system to a pump system and vice versa for fixed barrel sporting and defense guns.

The sporting and defense guns presently in use rely normally on a single operation principle either of the semi-automatic type such as gas operated backward moving barrel guns, fixed barrel guns using the kinetic recoil energy, etc., or of the manual pump type based on the movement of the cocking rod or handgrip in a direction parallel to the gun barrel guided by a tubular magazine mounted on a support structure secured to the barrel.

It is apparent that each of the above mentioned operation principles has peculiarities or deficiencies which are not complementary and compel almost always to make selective choices in favour of the one or the other but which do not comply with all requirements of use.

Approaches have been already made to combine on the same arm a semi-automatic gas operation and a manual pump operation, but they have brought to very complex and expensive solutions.

It is an object of the present invention to provide a reconversion device of the above mentioned type which has not the disadvantages of the approaches in this sense made up to now, by starting from a particular semi-automatic operation type of gun, more particularly that described in the Italian Pat. No. 762.319. This gun is of the fixed barrel type using the kinetic recoil energy of the arm for the ejection of the cartridge and the recocking of the arm. It includes a breech bolt head separated from the remaining breech bolt (hereinafter simply referred to as breech bolt) with a spring freely interposed between them, having the function of making elastic the recoil of the mass of the breech bolt against the breech bolt head thus cushioning the recoil serving to automatically register the release of the locking system thus providing a delay time at the opening, and causing by its reaction to the backward movement of the whole breech bolt head—breech bolt system the ejection of the cartridge and the recocking of the arm.

More particularly, the reconversion device according to the invention is characterized in that it comprises an annular control handle rotatably supported on a ring secured to an end of a tubular cocking rod axially slidable on a tubular magazine, said handle and said ring being provided with means for their mutual snap action engagement in four positions at 90° to one another, said handle having, projecting from an end front face thereof, two diametrically opposite sectors each ending in a tooth and the front face of a support of the magazine, secured to the barrel, facing the end front face of the handle having an annular recess, with two diametrically opposite passages with a height larger than that of the remaining recess, said recess communicating with an annular undercut groove in the support, the two passages of the annular recess having a larger height being adapted to receive the teeth of the two sectors projecting from the end front face of the handle, the four snap engagement positions of the handle and the ring secured to the cocking rod corresponding, alternately, to the engagement of the teeth of the two sectors in the undercut groove in the support of the magazine and the disengagement of the teeth of the two sectors from said undercut groove.

By engaging, by means of a rotation of the control handle the handle teeth in the magazine support secured to the barrel, the whole cocking rod group is locked to the barrel providing the semi-automatic operation system using the kinetic recoil energy of the arm according to the Italian Pat. No. 762.319.

By disengaging the control handle teeth from their seat in the magazine support, it is possible, by means of a rotation of the handle, to stop the handle in a disengaged position and allow the whole cocking rod group to slide in a direction parallel to the gun barrel. There is thus provided the pump operation system of the arm according the which the opening of the breech bolt and the recocking of the arm is obtained by means of a manual movement of the cocking rod.

The invention has the following advantages with respect to the solutions suggested up to now in the field of the reconversion of the sporting and defense guns:

- elimination of the to-day existing anchoring on pump guns between braces secured to the cocking rod and the breech bolt;
- extreme simplicity and reliability of the system deriving from the semi-automatic type operation to which it is associated which completely eliminates the gas part thus reducing the number of components to full benefit of economy;
- limited overall size of the whole mechanism which enables to completely balance the increase in the weight of the arm with respect to the guns presently in use and makes easier its manoeverability and transport;
- possibility to shoot both very low energy non lethal ammunition by using the manual repetition pump operation system and high stopping power ammunition with all the recocking rapidity advantages of the semi-automatic operation system.

A more ample and detailed explanation of the invention is given hereinafter it being understood that only for descriptive purposes there is illustrated an application of the reconversion device object of the invention on a sporting gun of which all those parts are omitted which operate in a manner similar to that of the arms at present in use.

In the three accompanying sheets an illustration of the reconversion device according to the invention is shown in the following sequences:

FIG. 1 shows in sectional view the reconversion device in the condition of semi-automatic operation of the arm;

FIG. 2 shows a view, partly in section, of the reconversion device in an intermediate condition between the semi-automatic and the pump operation of the arm;

FIG. 3 shows a cross-sectional view of the reconversion device;

Figure 4:
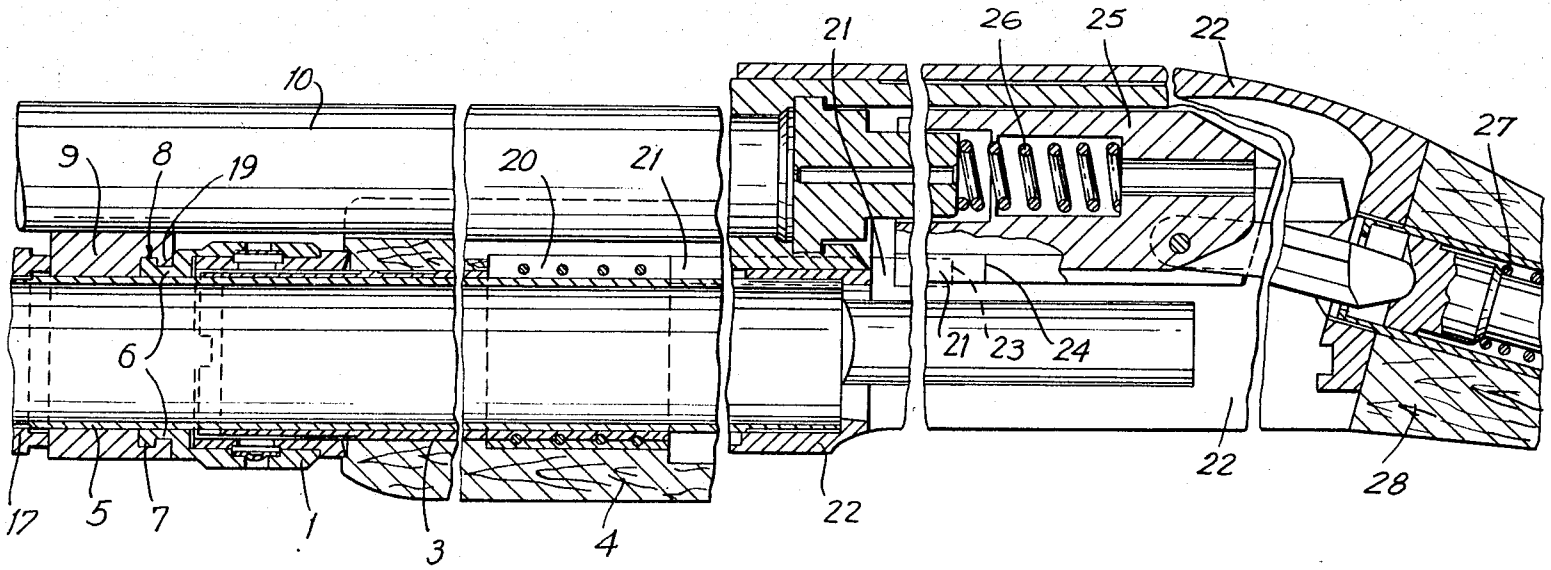
FIG. 4 shows in fragmentary sections the whole arm with the reconversion device in the condition of semi-automatic operation.

The reconversion device according to the invention consists (FIG. 1) of a knurled annular control handle 1 mounted on a ring 2 which is internally threaded and secured to a cocking rod 3 provided with a handgrip 4 and slidable on a tubular magazine 5.

The annular handle 1 carries on its front side two sectors 6, of which only one is shown since the other, quite similar, is in a diametrically opposite position, both sectors being provided with a tooth 7 adapted to engage an undercut groove 8 in a support 9 of the magazine secured to the barrel 10.

The annular control handle 1 is mounted (FIG. 3) on the threaded ring 2, screwed on the cocking rod 3 by means of a flat semicircular spring 11 which permits a complete rotation through 360° of the control handle about an axis with four indexing positions, every 90° one, individually determined by the engagement of a wedge folded end 12 of the spring with one of four holes 13 provided in the annular control handle 1, because of the tension of the spring, but does not permit the longitudinal sliding of the control handle in a direction parallel to the barrel of the arm.

The flat spring 11 in fact, because of the tension it undergoes in the position it is mounted (FIG. 3), engages both the annular groove 14 in the control handle 1 and the groove 15 facing the groove 14 provided in the internally threaded ring 2 secured to the cocking rod 3.

A hook folded end 16 of the flat spring 11 engaging through a hole in the ring 2 a notch in the cocking rod 3 determines the tension of the spring 11 and keeps it still when the control handle 1 is rotated to select the type of arm operation.

The semi-automatic operation of the arm is determined (FIG. 4) by the engagement of the tooth 7 of the sector 6 of the control handle in the groove 8 of the support 9 of the magazine 5 secured to the barrel 10.

In this position the cocking rod 3 provided with an appropriate handgrip 4 is made integral with the barrel 10 secured to the arm by means of the plug 17 screwed on the magazine 5.

To achieve this, starting from the position in FIG. 2 of the control handle 1, it is sufficient to insert the sectors 6 in the groove 8 of the support 9 through suitable passages 18 provided in the annular abutment 19 of the support 9 defining the groove 8, and to rotate the control handle 1 by one step equal to 90° until its sectors 6 are brought in the position of FIG. 4.

During the semi-automatic operation of the arm the extension 20 of the cocking rod welded to the latter, which extends by means of the braces 21, indicated in the various sectional fragments of FIG. 4, along the whole length of the magazine 5 until the inside of the housing 22, never abuts, by means of the faces 23 of the braces 21, the face of the inertial mass 25 of the breech bolt.

The space left is sufficient to determine the compression of the spring 26 because of the kinetic recoil energy of the arm and, as a result, the opening, the ejection of the cartridge and, next, the return to closed position because of the return spring 27 disposed inside the stock 28; everything according to the contents of the Italian Pat. No. 762.319 which covers this semi-automatic operation system.

The pump manual repetition operation system of the arm is determined (FIG. 5) by the sliding, in a direction parallel to the barrel, of the cocking rod 3 together with the handgrip 4, the extension 20 and the braces 21 as well as the control handle 1 mounted on the threaded ring 2 screwed on it.

Figure 5:
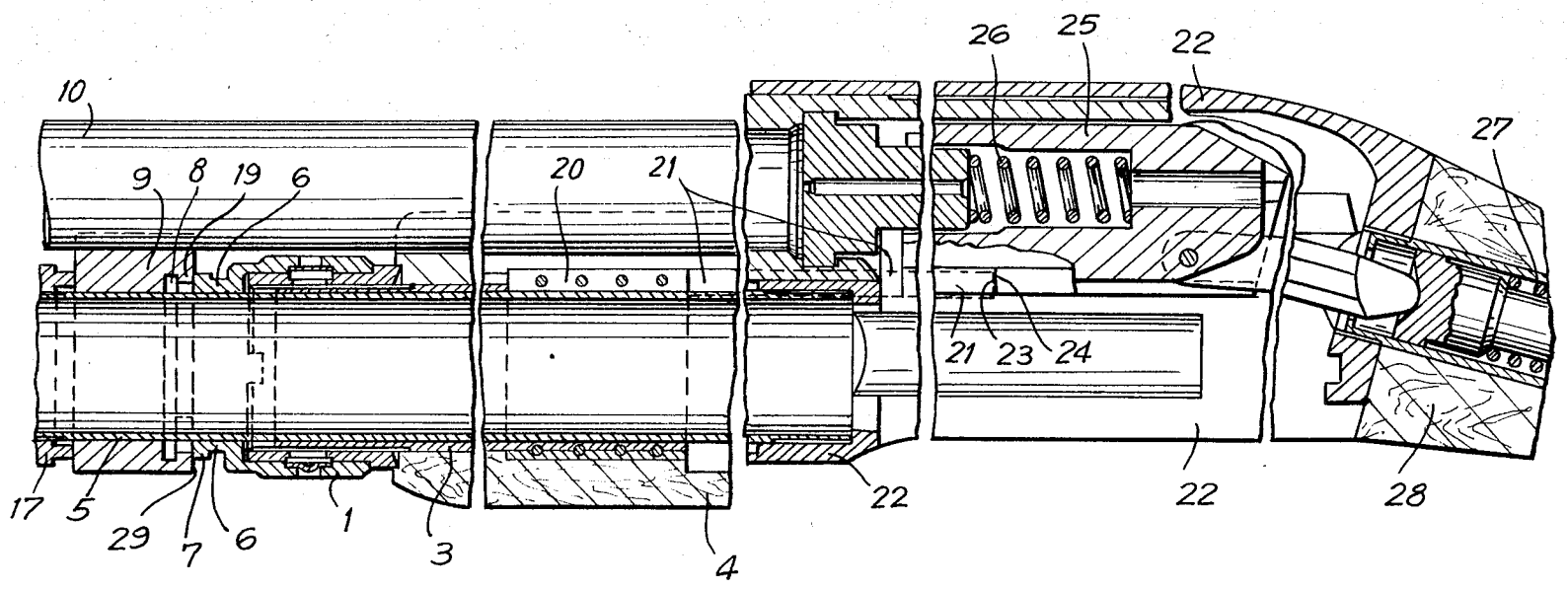
FIG. 5 shows in fragmentary sections the whole arm with the reconversion device in the condition of manual repetition pump operation by movement of the cocking rod.

To achieve this, starting from the position in FIG. 2 of the control handle 2, it is sufficient to rotate it by a step equal to 90°, until its sectors 6 are brought in the position of FIG. 5, not inserted in the groove 8 in the support 9 of the magazine 5 secured to the barrel 10, but abutting the front face 29 of the support.

In this position the extension 20 of the cocking rod 3 welded to the latter which extends by means of the braces 21, indicated in the various sectional fragments of FIG. 5, along the whole length of the magazine 5 until inside the housing 22, abuts by means of the faces 23 of the braces 21 the face 24 of the inertial mass 25 of the breech bolt.

Thus, it is no longer possible, because of the kinetic recoil energy of the arm, the compression of the spring 26 and, as a result, the semi-automatic operation of the arm.

Only by pulling back, at the end of the stroke, the whole above mentioned recocking rod group, by means of the handgrip 4, there is effected the opening of the arm, the ejection of the cartridge and next, in the position of FIG. 5, its return in closed position because of the return spring 27 disposed inside the stock 28 since no mechanical correction exists between the braces 21 and the inertial mass 25 of the breech block.

The same return spring 27 also keeps the whole cocking rod group forwardly when the arm not being in use, the handgrip 4 is not actuated by hand.

It is apparent, from the above description, that the transition from the semi-automatic to the pump operation is effected without disassembling the arm by a simple rotation of the control handle 1 by inserting or not its sectors 6 in the groove 8 of the support 9 of the magazine 5.

The whole reconversion system reaches therefore the purpose of having on the same arm two different easily selectionable types of operation which amplify its performance making it more responsive to all different requirements and conditions of use.

The invention can be put into practice in other specific manners, different from that described, without departing from the spirit and the essential technical features of the invention.

The described embodiment is therefore to be considered, to all effects, as illustrative and not limiting; all changes falling within the equivalents of the appended claims are understood as included in the claims.

I claim:

1. Reconversion device from a semi-automatic operation of the fixed barrel type using the kinetic recoil energy of the arm for the ejection of the cartridge and the recocking of the arm and comprising a breech bolt head separated from the breech bolt with a spring freely interposed between them, to a pump system, characterized in that it comprises an annular control handle rotatably supported on a ring secured to an end of a tubular cocking rod axially slidable on a tubular magazine, said handle and said ring being provided with means for their mutual snap action engagement in four positions at 90° to one another, said handle having, projecting from an end front face thereof, two diametrically opposite sectors each ending in a tooth and the front face of a support of the magazine, secured to the barrel, facing the end front face of the handle having an annular recess with two diametrically opposite passages having a height larger than that of the remaining annular recess, said recess communicating with an annular undercut groove in the support, the two passages of the annular recess having a larger height being adapted to receive the teeth of the two sectors projecting from the end front face of the handle, the four snap engagement positions of the handle and the ring secured to the cocking rod corresponding, alternatively, to the engagement of the teeth of the two sectors in the undercut groove in the support of the magazine and the disengagement of the teeth of the two sectors from said undercut groove.

2. Device as claimed in claim 1, characterized in that the control handle is connected to the ring secured to an end of the cocking rod by means of a flat semicircular spring which is located partially in a first annular groove provided in the inner wall of the control handle and partially in a second annular groove provided in the outer wall of the ring secured to the cocking rod, said grooves facing one another, said flat spring having one end folded in the shape of a hook permanently engaging, through a hole provided in the ring, a notch provided in the cocking rod, and the other end folded in the shape of a wedge adapted to selectively engage one of four holes in the control handle disposed at 90° from one another.

3. Device as claimed in claim 1 or 2, characterized in that the cocking rod has an extension having a front face, facing a front face of the breech bolt, said extension having such a length that when the control handle is in a position in which the teeth of the sectors projecting from one end front face of the control handle are disengaged from the undercut groove in the support of the magazine, the front face of the extension of the cocking rod abuts the front face of the breech bolt facing said front face of the extension of the cocking rod.

* * * * *